US009737158B2

(12) United States Patent
Kreppein

(10) Patent No.: US 9,737,158 B2
(45) Date of Patent: Aug. 22, 2017

(54) INTEGRAL HEAD SUPPORT APPARATUS AND SYSTEM

(71) Applicant: TripGear LLC, Charlotte, NC (US)

(72) Inventor: Kevin Kreppein, Charlotte, NC (US)

(73) Assignee: TRIPGEAR LLC, Charlotte, NC (US)

( * ) Notice: Subject to any disclaimer, the term of this patent is extended or adjusted under 35 U.S.C. 154(b) by 293 days.

(21) Appl. No.: 14/675,737

(22) Filed: Mar. 31, 2015

(65) Prior Publication Data

US 2015/0274044 A1 Oct. 1, 2015

Related U.S. Application Data

(60) Provisional application No. 61/973,236, filed on Mar. 31, 2014.

(51) Int. Cl.

| | |
|---|---|
| ***A47G 9/10*** | (2006.01) |
| ***A47C 16/00*** | (2006.01) |
| ***A47C 7/38*** | (2006.01) |

(52) U.S. Cl.

CPC ..... *A47G 9/1081* (2013.01); *A47C 7/383* (2013.01); *A47C 16/00* (2013.01); *A47G 2009/1018* (2013.01)

(58) Field of Classification Search

USPC ..... 297/393

See application file for complete search history.

(56) References Cited

U.S. PATENT DOCUMENTS

| | | | | |
|---|---|---|---|---|
| 16,300 A | | 12/1856 | Wilson | |
| 382,949 A | | 5/1888 | Campbell | |
| 1,579,585 A | | 4/1926 | Wieder et al. | |
| 4,097,086 A | | 6/1978 | Hudson | |
| 4,560,201 A | | 12/1985 | Scott | |
| 5,129,705 A | * | 7/1992 | Wray | A47C 7/383 297/397 |
| 5,511,854 A | * | 4/1996 | Cordia | A61F 5/3707 297/393 |
| 5,785,388 A | * | 7/1998 | Curtis | A47C 7/383 297/397 |

(Continued)

FOREIGN PATENT DOCUMENTS

| | | |
|---|---|---|
| WO | WO2013131767 A2 | 9/2013 |

*Primary Examiner* — David E Allred

(74) *Attorney, Agent, or Firm* — Damian Wasserbauer, Esq.; Wasserbauer Law LLC

(57) ABSTRACT

An integral head sling support apparatus and system for a person for use primarily during travel, comprising a head band or piece adapted to fit around the forehead of the person and a harness extending from the headband assembly to a sling assembly adapted to receive the person's arms. The integral head sling support further comprises a headrest assembly of a neck pillow and guide for one or more straps configured to utilize the weight of the persons arms in the sling assembly to pull rearward the person's head and anchor while supporting the person's head so that the person can sleep in an upright seated position. The one or more adjustable straps may be a portion of the sling assembly pass behind the head, along the back and under the person's armpits so that when the person is seated and places their arms in the sling assembly, the weight of the person's arms provide the weight of an anchor for the integral head sling support apparatus and system.

18 Claims, 9 Drawing Sheets

(56) References Cited

U.S. PATENT DOCUMENTS 6,266,832 B1 * 7/2001 Ezell ..... A47G 9/10 297/219.12
6,394,554 B1 * 5/2002 Hingle ..... A47C 7/383 297/397
6,434,770 B2 * 8/2002 Matthews Brown .. A47C 7/383 297/393
6,435,617 B1 * 8/2002 McNair ..... A47C 7/383 297/397
6,755,463 B2 * 6/2004 Lardieri ..... A47C 1/03 297/35
6,786,554 B1 * 9/2004 Zahiri ..... A47C 7/383 297/393
7,000,766 B2 * 2/2006 Matthews Brown .. A47C 7/383 206/521
7,055,908 B1 * 6/2006 Williams ..... B60N 3/00 297/392
8,783,776 B1 * 7/2014 Perkins ..... A47D 15/00 297/219.12
9,408,471 B2 * 8/2016 Higa ..... A47C 7/383
9,580,041 B1 * 2/2017 Leung ..... B60R 22/10
2004/0026979 A1 2/2004 Haddon
2010/0117435 A1 5/2010 Samuelsen
2011/0043025 A1 * 2/2011 Park ..... B60N 2/4879 297/393
2013/0088063 A1 * 4/2013 Montes ..... B60N 2/4882 297/393
2013/0226055 A1 * 8/2013 Akpotaire ..... A61F 5/055 602/18
2014/0315695 A1 * 10/2014 Scott ..... A63B 21/00185 482/91
2015/0042143 A1 * 2/2015 Maginness ..... A47C 7/383 297/393
2016/0135625 A1 * 5/2016 Cante ..... A47C 7/383 5/644
2017/0007908 A1 * 1/2017 McNeil ..... A63B 71/1291

* cited by examiner

INTEGRAL HEAD SUPPORT APPARATUS AND SYSTEM

CROSS-REFERENCE TO PRIORITY PROVISIONAL APPLICATIONS

This application claims priority under 35 U.S.C. §120 of U.S. Provisional Applications No. 61/973,236 for Head and Neck Support Pillow For Keeping User's Head Upright, filed Mar. 31, 2014, which is hereby expressly incorporated by reference in its entirety and assigned to the assignee hereof.

FIELD OF THE INVENTION

The present invention relates to travel pillows and other traveler gear products and more particularly to a head and neck support for a person seated in travel designed to keep the user's head upright and rearward while at rest using the weight of the user's shoulders and arms.

BACKGROUND OF THE INVENTION

Conventional head rests and/or travel pillow are known in the art. The popular yoke neck pillow provides comfort yet a person's head will not be maintained against the rest once the person falls asleep when bumps and jostling of travel occur. As a result, yoke type pillows along have disadvantages that the head will fall forward waking the person and interrupting the person's rest.

Various travel devices and pillows have been tried to improve rest for a person when travelling in an upright position as illustrated in U.S. and foreign Patent and Patent Publication Nos. 16,300 A, 382,949 A, U.S. Pat. No. 1,579,585 A, U.S. Pat. No. 4,097,086 A, U.S. Pat. No. 4,560,201 A, 2004/026,979 A1, and 2010/114,435 A1. For example, a neck pillow with straps in the front have been disclosed in the art and the configuration uses straps across the front torso to attach to the persons arms so as to utilize the weight of the user's arms to hold the head in the upright position as shown in U.S. Pat. Nos. 16,300 A, 382,949 A, U.S. Pat. No. 1,579,585 A and U.S. Pat. No. 4,560,201 A.

Other arrangements have been disclosed in the art and the configuration uses straps to attach to the backrest of the chair as shown in U.S. Pat. No. 4,097,086 A and U.S. Patent Publication No. 2010/114,435 A1.

Still yet other arrangements have been disclosed in the art and the configuration uses straps to attach to the thighs of the individual and back of the chair as shown in U.S. Patent Publication No. 2004/026,979 A1 and WIPO International Publication No. WO 2013/1311467 A2.

However, these have limited commercial success as the head will not be maintained against the rest or in a resting position. These have disadvantages of comfort to the user as the user's head will fall forward due to bumps and jostling inherent in travel means. For example, in the prior art, these have disadvantages in pulling the user's head forward waking the person and interrupting the person's rest. Moreover, their appearance is less than desirable in present day aircraft, busses and cars. Therefore, there is a long-felt need for a travel pillow or a neck pillow device that will maintain the user's head against the headrest during travel.

The present invention is directed to a unique solution for this problem and provides complete and adequate support of the head in the rearward direction. The neck of the user is supported and the head is anchored against forward movement in order to relieve the neck muscles and hold the head in a comfortable position. Moreover, the apparatus and system can be folded or rolled into a very compact size for easy storage and use as a standard pillow. The apparatus and system accomplishes this in a comfortable way that results in the traveler obtaining satisfactory and relaxing rest. The present invention provides unique and unexpected result in that it is quite comfortable and restful to use.

SUMMARY OF THE INVENTION

It is an object of the present invention to provide an apparatus, system and method of keeping the user's head from falling forward while the user is upright and at rest.

It is an object of the present invention to provide an apparatus, system and method of the TripGear™ pillow configured with elastic and straps to secure the head in an upright position with the use of a small neck roll or pillow; straps use the weight of the user's shoulders and arms to add tension to pull the head back slightly around the neck roll. Also, although the neck roll or pillow adds comfort as it is in the way the straps keep the head upright and, specifically, that the straps are around the back of the user rather than in front.

It is an object of the present invention to provide a stand-alone product as well as a product that can be secured to neck pillows already on the market.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein.

DESCRIPTION OF THE EMBODIMENTS

Figure 3:
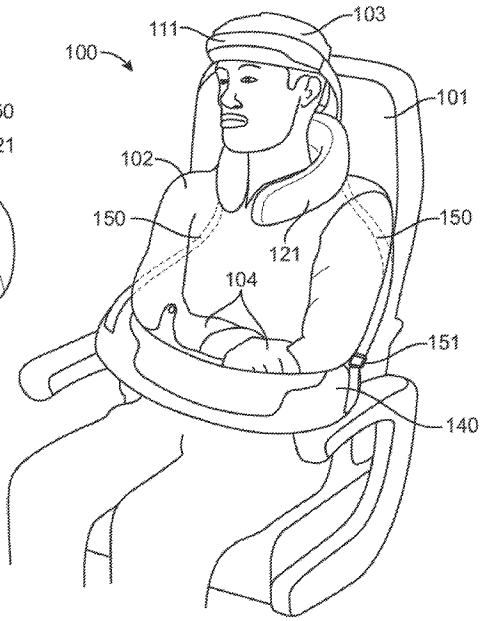
FIG. 3 illustrates a schematic perspective view of head sling apparatus and system utilized by a person in seated travel in accordance with an embodiment of the present invention.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "head sling" refers to a device configured to keep the head upright using straps around the forehead, down the back and shoulder's of the user and then to the front where the weight of the arms are used to anchor the head rearward.

Figure 2:
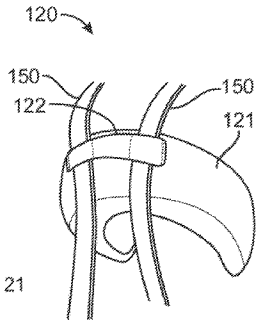
FIG. 2 illustrates a schematic rear view of the headrest assembly and pillow.
Figure 1:
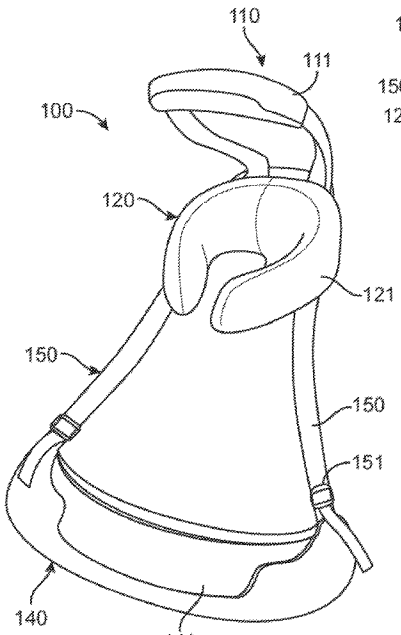
FIG. 1 illustrates a schematic perspective view of the head sling apparatus and system in accordance with an embodiment of the present invention.

As is illustrated in FIGS. 1-16, a head sling apparatus and system is generally designated as element 100. The present invention is described in connection with a seat 101 for a person or user 102 that may be traveling by train, car, air, or other methods of travel where the person 102 seeks to rest on the journey. Referring to FIGS. 1-3 a head sling apparatus and system 100 comprises a headband assembly 110, a head rest assembly 120 connected to a sling assembly 140 by one or more adjustable straps 150. It should be appreciated that various other alternative embodiments are contemplated.

Figure 10A:
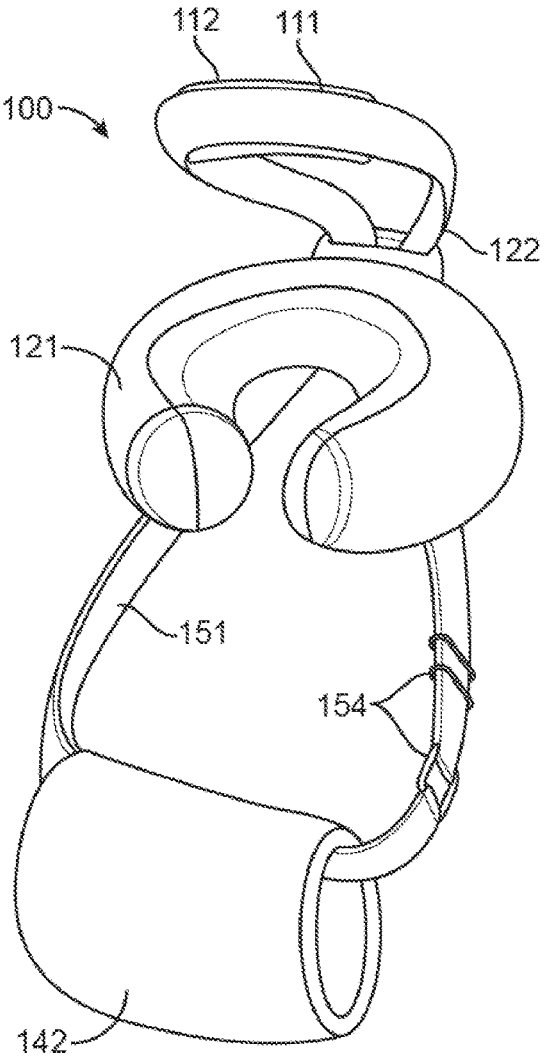
FIGS. 10A, 10B, and 10C illustrate a schematic perspective views of an integral muffler sling in accordance with another embodiment of the head sling apparatus and system of the present invention.
Figure 10B:
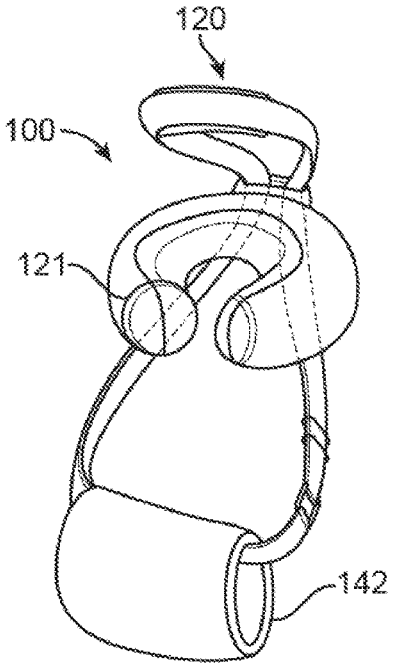
Figure 10C:
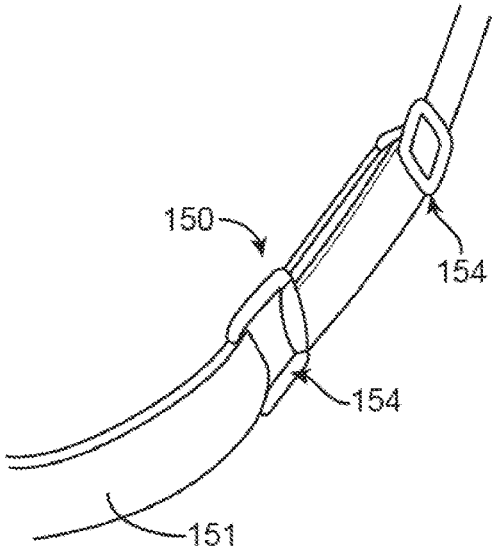

Referring to FIGS. 1-3, 4, 5, 9, 10A-10C, 12A-12B, 13A-13F and 14A-14C, the headband assembly 110 comprises a forehead pad 111 that may be configured with a replacement comfort pad 112 as is shown in FIG. 10C. The forehead pad 111 is connected to the sling assembly 140 by the one or more adjustable straps 150. An alternative embodiment of the present invention, shown in 13A-13F, the headband assembly 110 may be formed in a unitary construction with the sling assembly 140. As shown in FIGS. 1-3, the one or more adjustable straps 150 are disposed within a guide 122 formed on the neck pillow 121 and the guide 122 may be a specific guide for each strap 150, for example, as is illustrated in FIGS. 13A and 13B.

Figure 5:
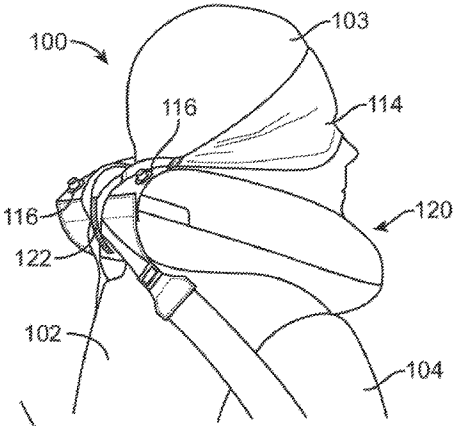
FIG. 5 a schematic side view of head sling apparatus and system positioned with eye pad shade on the person in accordance with an embodiment of the present invention.
Figure 4:
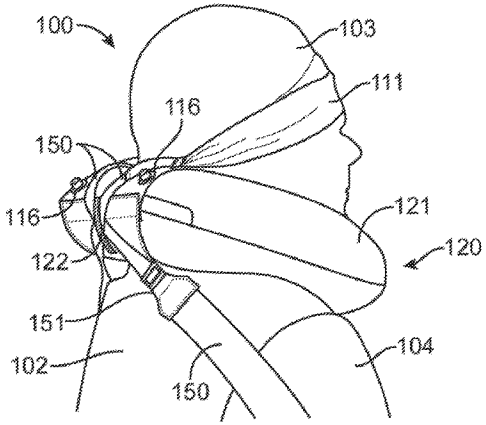
FIG. 4 illustrates a schematic side view of head sling apparatus and system positioned on the person in accordance with an embodiment of the present invention.

Referring to FIGS. 4 and 5, the headband assembly 110 may also be formed to provide an eye shade 114 such as, for example, an integral eye pad shade 114 for blocking out light when the user 102 is seeking to rest. The headband assembly 110 may also be formed of fabric material that can cover the four head 103 and be drawn across the eyes of the user 102 when rest and blocking out of light is desired. Suitable fabrics are materials of strength and comfort to the user such as, for example, fabrics that have elastomeric properties and breathability.

Referring to FIGS. 1-3, 6, 10A-10C, 13A-13F and 14A-14C the head sling apparatus and system 100 utilizes one or more straps 150 having an adjustment means 151 such as a chord adjustment assembly 152 (FIGS. 13A-13F), a hook and loop adjustment assembly 153 (FIGS. 14A-14C), a buckle adjustment assembly 154 (FIGS. 10A-10C), or other suitable adjustment system. The adjustment means 151 functions to adjust the distance between the user 102 arms 104 in the sling assembly 140 so as to provide sufficient and comfortable rearward force by the weight of the arms 104 through the one or more adjustable straps 150, the neck pillow 131, and headband assembly 110 as is shown in FIGS. 3, 7, 12A-12B, 13F, and 14C.

Figure 6:
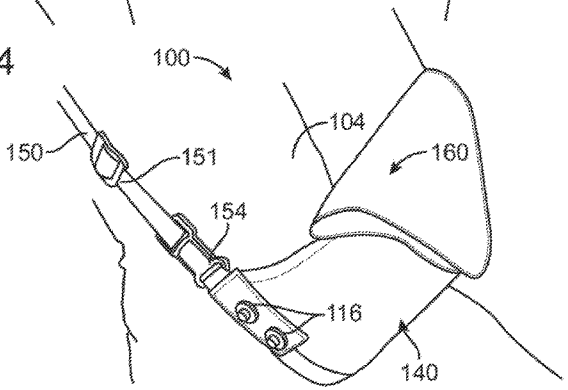
FIG. 6 illustrates a schematic side view of the loop of a strap extending from the head-to-sling
Figure 7:
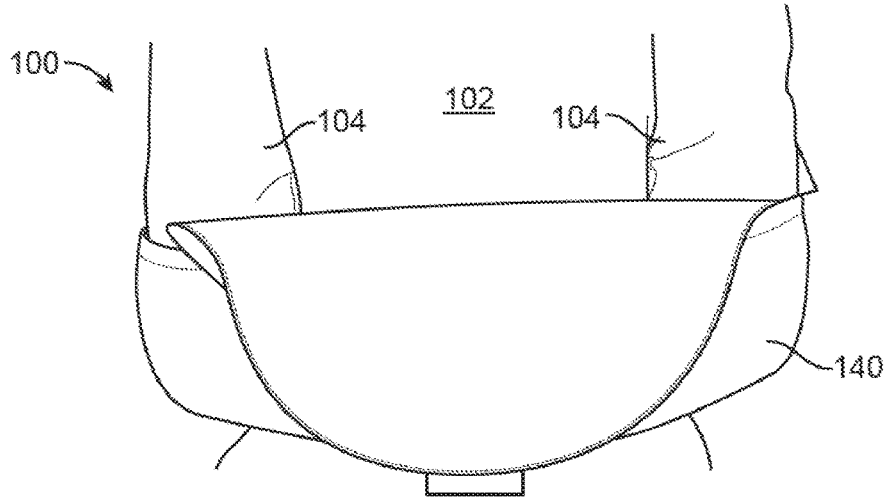
FIG. 7 illustrates a schematic front view of the sling assembly.
Figure 8:
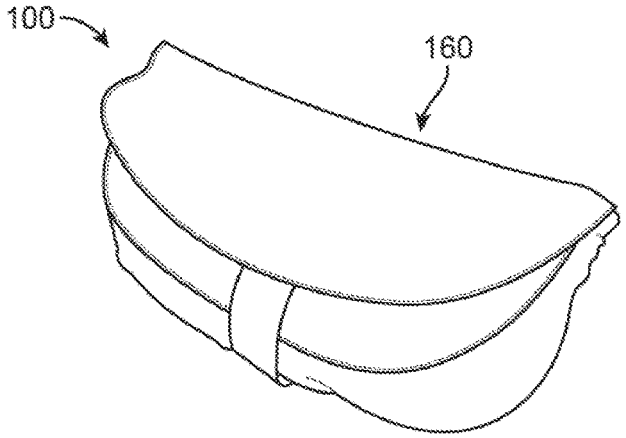
FIG. 8 illustrates a schematic view of the head sling apparatus and system folded in the case assembly.
Figure 9:
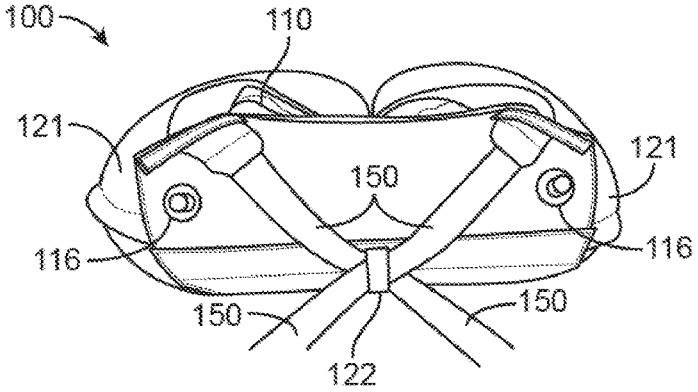
FIG. 9 illustrates a rear view of the headrest assembly and one or more straps in accordance with an embodiment of the present invention.

The sling assembly 140 can be configured to attach to the free ends of integral straps 150 as is shown in FIG. 6. The sling assembly 140 is configured to cradle a person's arms, for example, a pocket or a hammock-type design to put into the arms 104 of the user as is shown in FIGS. 3, 7, 12A-12B, 13F, and 14C. The head sling apparatus and system 100 can include and have headrest assembly 120 configured to integrate with straps 150 through a guide or securing tab 122 at a neck portion located between the head band assembly 110 and the sling assembly 140, as is shown in FIGS. 1-5, 9, 10A-10C, 13A-13F and 14A-14C.

Figure 14C:
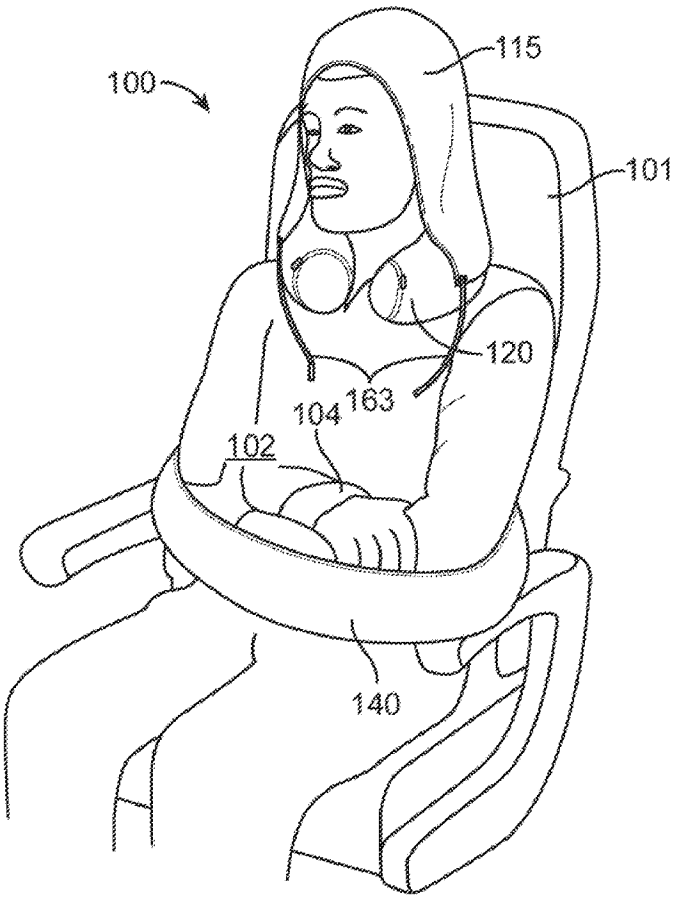
FIGS. 14A, 14B, and 14C illustrates a schematic perspective views of head sling apparatus and system with a hood utilized by a person in seated travel in accordance with another embodiment of the present invention.
Figure 14B:
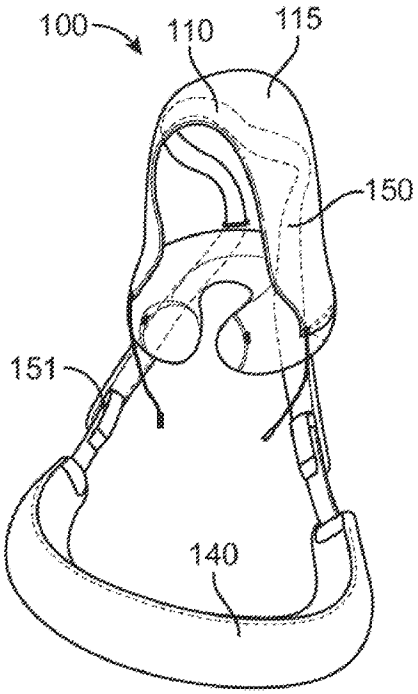
Figure 14A:
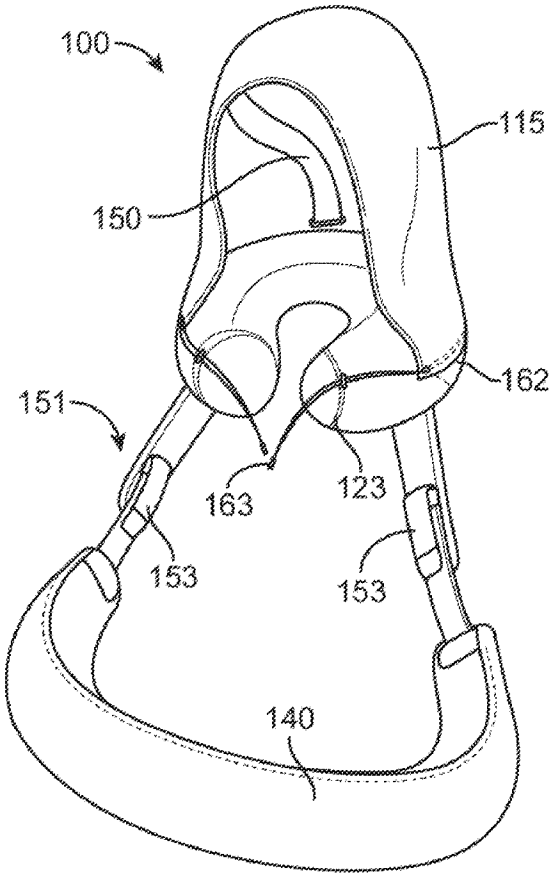

Referring to FIGS. 1 and 2 an embodiment of the head sling apparatus and system 100 has the headband assembly 110 can be configured from durable materials such as neoprene and other poly-materials. Various alternative embodiments of the headband assembly 110 are contemplated including configuring with a forehead pad 111 having comfort foam pads 112, an eye shade 114 that can fold away or be integral to the forehead pad, or hood 115 (FIGS. 14A-14C). As is shown in FIGS. 1 and 2, head sling apparatus and system 100 advantageously keeps the head upright using straps are around the head, down the back and shoulder's of the user and then to the front where the weight of the arms are used and the one or more straps 150 are arranged on the back of the person 102 rather than in front, which has disadvantages of allowing the head to be pulled forward and interrupts resting and/or sleeping. In alternative embodiment of the headband assembly 110 can include a headband portion that is formed of various composite materials to increase the comfort of the user such as, for example, durable materials like neoprene and other poly-materials.

Figure 13A:
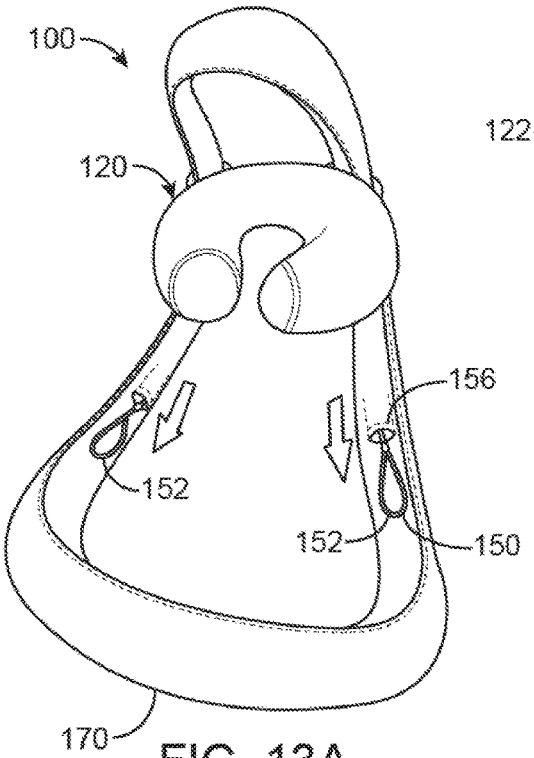
FIGS. 13A, 13B, 13C, 13D, 13E, and 13F illustrates a schematic perspective views of head sling apparatus and system utilized by a person in seated travel in accordance with another embodiment of the present invention.
Figure 13B:
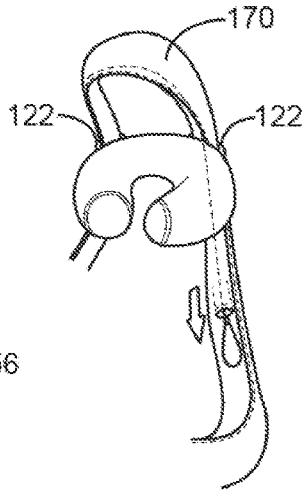
Figure 13C:
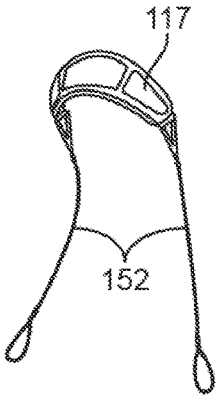
Figure 13D:
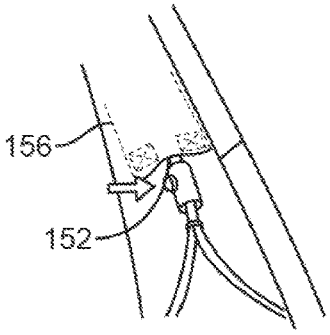
Figure 13E:
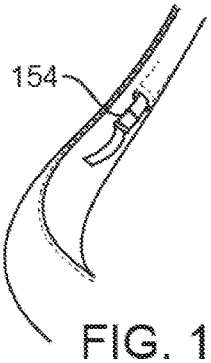
Figure 13F:
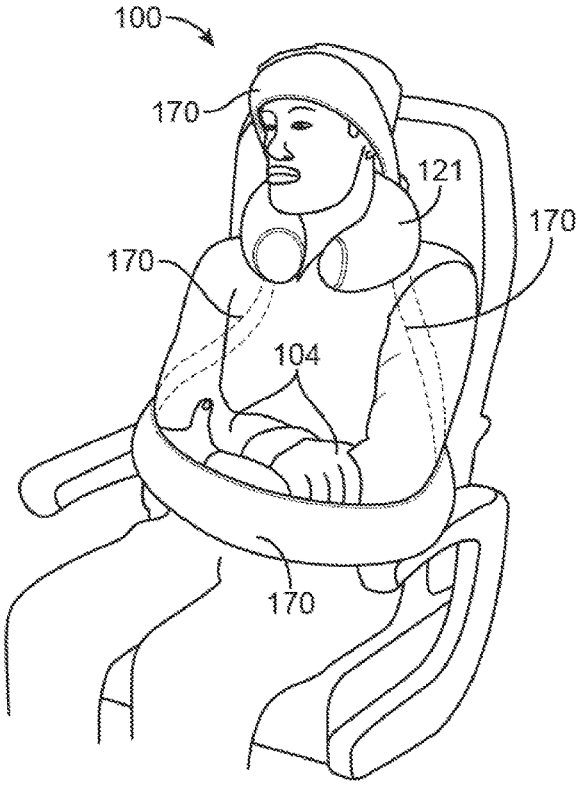

Referring to FIGS. 13A-13F an alternative embodiment of the head sling apparatus and system 100 has the headband assembly 110 can be configured from unitary, single loop from head-to-sling, shown as element 170. Comfort foam 117 can be formed in the headband assembly 110 for further comfort to the user as shown in FIG. 13C. In an alternative construction, the headband assembly 110 is configured with one or more adjustable straps 150 or a chord adjustment assembly 152 so that proper tension and adjustments to the user's dimensions can be easily made as shown in FIGS. 13A through 13F. The straps 150 or chord adjustment assembly 152 can be fitted through a channel 156 in the single-loop head to sling assembly.

Referring to FIG. 5 yet another alternative embodiment of the head sling apparatus and system 100 has the headband assembly 110 can be configured into a hood 115. Strings 119 in the hood 115 allow for tightening of the hood and or pillow 121. The hood 115 conceals the straps 150 of the headband assembly 110. The straps 150 can make adjustments to the sling 140 using a hook and loop fabric adjustment assembly 153 so that proper tension and adjustments to the user's dimensions can be easily made as is shown in FIGS. 14A through 14C.

Figure 11:
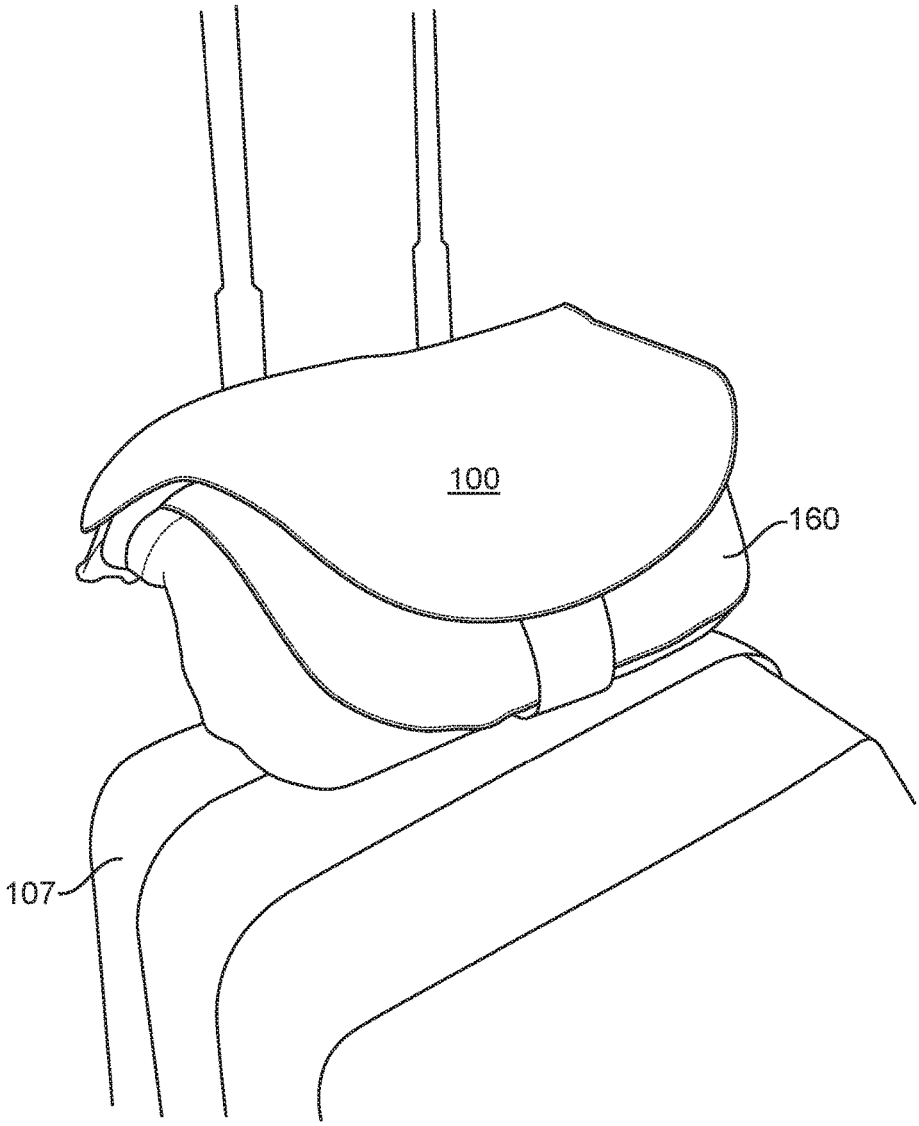
FIG. 11 illustrates a schematic perspective view of transporting the head sling apparatus and system in the case on luggage in accordance with an embodiment of the present invention.
Figure 16:
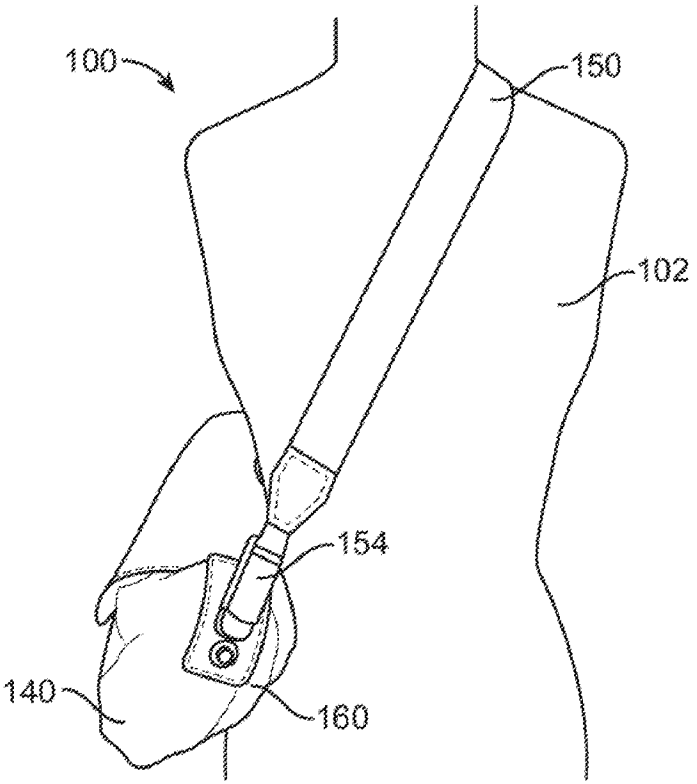
FIG. 16 illustrates a schematic perspective views of the adjustment means and buckle adjustment assembly of the head sling apparatus and system worn by a person travelling in accordance with another embodiment of the present invention
Figure 15:
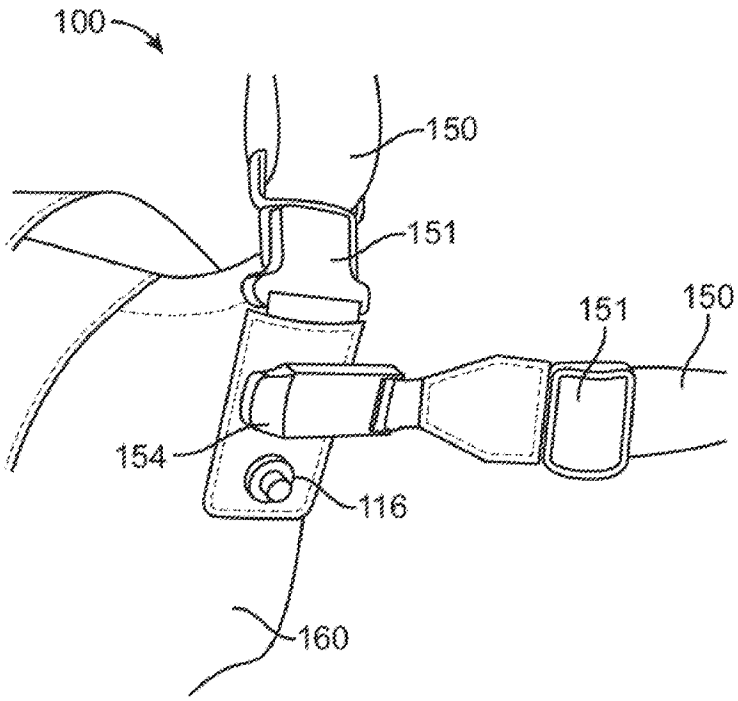
FIG. 15 illustrates a schematic perspective views of the adjustment means and buckle adjustment assembly of the head sling apparatus and system in accordance with another embodiment of the present invention.

Referring to FIGS. 1-3, 6, 10A-10C, 11, 13A-13F, 14A-14C, 15 and 16 another alternative embodiment of the head sling apparatus and system 100 has an integral case or pouch 160, which is configured using the sling assembly 140. The headband assembly 110 and straps 150 configured to attach to the integral sling-and-neck pillow 190 can advantageously fold into the case 160. The folded carrying case 160 can attached to any luggage 107 as shown in FIG. 11. The folded carrying case 160 can be used as a standard pillow such as, for example, in a hotel bed or to rest the head on alternatively. The ends of the straps 150 include a hook and loop adjustment 153 means that can be utilized to attach the free ends to allow the case 160 to be worn on the person 102 as a purse or satchel as is shown in FIGS. 15 and 16. The straps 150 can utilize one or more magnets 116 configured to secure to the buckle adjustment assembly 154, where by the adjustment means 151 may be formed make adjustments to case 160 according to the user's dimensions as is shown FIGS. 15 and 16.

Referring to FIGS. 10A-10C, according to another alternative embodiment of the head sling apparatus and system 100 has an integral muffler sling 170 that accepts the arms 104 of the person 102. As is illustrated in FIG. 10A, the headband assembly 110 may be formed from a forehead pad 111 and a replacement comfort pad 112. The replacement comfort pad 112 can utilize a composite structure for improved comfort, for example, a portion with memory foam that conforms to the body features of the user to improve comfort and a portion of another stiffer material useful for providing posture and support. The replacement comfort pad 112 allows a head sling apparatus and system 100 to be utilized between multiple users with replacing the comfort pad 112 if sanitary conditions are needed.

Referring to FIGS. 14A-14C, another alternative embodiment of the head sling apparatus and system 100 has an integral storage compartments for storing and securing various items a traveler may utilizes such as headphones, pens, candy, smart phone, tablet and the like. For example, headphone channels or integral headphones 200 may be formed in the headband 110. The sling assembly 140 may include a device pocket 141 that can have one or more divided pockets and can be closable. The neck pillow 121 can include a device pocket 123.

Figure 12B:
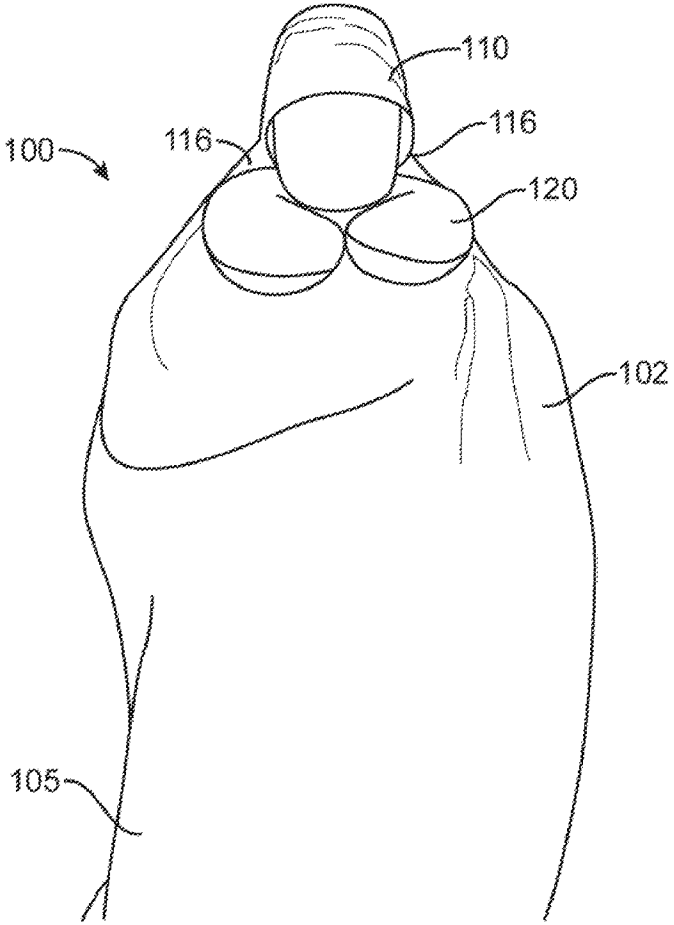
FIGS. 12A and 12B illustrate a schematic front view of a blanket used with the magnet tabs on the sling, or on the headband assembly as shown in FIG. 12B, of the head sling apparatus and system in accordance with an embodiment of the present invention.
Figure 12A:
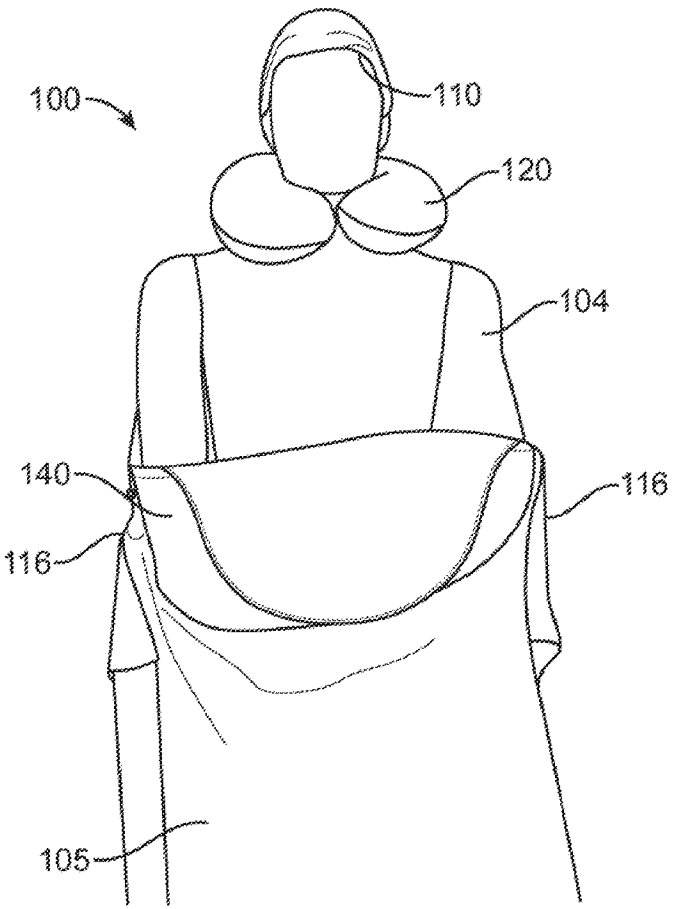

Referring to FIGS. 4-6 and 12A-12B, the head sling apparatus and system 100 can be configured with one or more magnet tabs 116. As shown in FIGS. 4-6, the magnet tabs 116 are utilized to adjust the sling assembly 140 and strap assembly 150. A blanket 105 may also be provided with magnetic tabs 116 disposed therein or thereon so as to attach to magnetic tabs on the headrest assembly 120 and/or the sling assembly 140. As shown in FIGS. 15 and 16, the magnet tabs 116 are utilized to adjust position of the a pouch 160 and/or the sling assembly 140 and strap assembly 150 and strap adjustment means 151. As shown in FIGS. 12A and 12B, the magnet tabs 116 advantageously may allow attaching a blanket 105 to magnetic tabs in the neck pillow 121 for full coverage of the blanket 105 or on the straps 150 half coverage of the person 102 by the blanket 105 as shown in FIG. 12A.

The head sling apparatus and system 100 can be configured and sold as individual parts. Referring to each of FIGS. 1 through 16, the variations can be combined in multiple combinations that form the system 100. For example, a neck pillow 121 can be sold individually with varying the materials and construction of different materials to provide comfort and/or lumbar support. The headband 110 can be sold individually with different materials and/or features such as, for example, a forehead pad 111 having comfort foam pads 112, an eye pad 114 that can fold away or be integral to the forehead pad, or hood 115. The headband 110 and sling assembly 140 can be sold individually with different materials and/or features such as, for example, with different attachment means of forehead pad 111, foam pads 112, an eye pad 114 or hood 115. The headband 110 and sling 140 can be sold individually with different materials and/or features such as, for example, with different an adjustment means 151 such as, for example, a chord adjustment assembly 152, a hook and loop adjustment assembly 153, and a buckle adjustment assembly 154. The headband 110 and sling 140 can be formed as a muffler 142 or integral headband to sling assembly 170 and sold individually with different materials and/or features including being configured to fold advantageously into a carrying pouch or case 160. Moreover, the integral storage compartments 161 for storing and securing various items a traveler may utilizes such as headphones, pens, candy, smart phone, tablet and the like such as headphone wire channels 162 or integral headphones 163 formed in the headband assembly 110, having one or more divided device pockets 141 (closeable) in the sling assembly 140), and a device pocket 123 in the neck pillow 121.

While certain configurations of structures have been illustrated for the purposes of presenting the basic structures of the present invention, one of ordinary skill in the art will appreciate that other variations are possible which would still fall within the scope of the appended claims. For example, varying the colors, fabrics and the opportunity to utilize branding are contemplated. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A head support apparatus for allowing a user to rest while sitting in a generally upright position, the device comprising:

(a) a headband assembly configured to be secured to the user's forehead for supporting in a rearward position to restrain the user's head from moving further forward and sideways;

(b) a sling assembly configured to accept the user's arms;

(c) one or more straps configured to connect said headband assembly to said sling assembly and forming a single continuous closed loop;

(d) a headrest assembly comprising a neck pillow configured as a yoke having a rear portion adapted to rest behind a user's neck, and a guide formed as a closed loop through which the one or more straps can freely slide to receive said one or more straps, said neck pillow adapted to receive the neck of the user, said guide located on a rear surface of the neck pillow and adapted to be spaced by the neck pillow away from the back of the neck of the user, whereby the head support apparatus is configured to restrain the user's head from moving forward and sideways by a combined force of the closed loop formed between by the headband assembly, the one or more straps, and the sling assembly, by the headband assembly pulling rearward on the user's forehead through the one or more straps and by the user's arm weight in the sling assembly.

2. The head support apparatus of claim 1 wherein said headband assembly includes a forehead pad.

3. The head support apparatus of claim 2 wherein said headband assembly includes a resilient comfort pad attached to an inside surface of said forehead pad, whereby said comfort pad is adapted to be located between the user's forehead and said forehead pad in the closed loop pulling rearward the head of the user.

4. The head support apparatus of claim 3 wherein said comfort pad is formed from memory and/or comfort foam.

5. The head support apparatus of claim 1 wherein said headband assembly includes an eye shade.

6. The head support apparatus of claim 1 wherein said headband assembly includes a hood.

7. The head support apparatus of claim 1 wherein said headband assembly includes integral headphones.

8. The head support apparatus of claim 1 wherein said neck pillow comprises at least a portion of material formed from memory and/or comfort foam.

9. The head support apparatus of claim 1 wherein said neck pillow includes a device pocket.

10. The head support apparatus of claim 1 wherein said neck pillow includes a headphone wire channel.

11. The head support apparatus of claim 1 wherein said one or more straps having a means for adjusting the length of said one or more straps so as to adapt the head support apparatus to the dimension of the user, whereby said adjusting means adjusts the length of the closed loop with respect to the arms and forehead of the user.

12. The head support apparatus of claim 11 wherein said adjusting means comprises a means for adjusting selected from the group of a chord adjustment assembly, a hook and loop assembly, a buckle adjustment assembly, and/or a buckle and magnetic tab assembly.

13. The head support apparatus of claim 11 wherein said adjusting means comprises flexible closed loop from elastomeric fabric to form a unitary headband assembly to sling assembly.

14. The head support apparatus of claim 1 further comprising an integral headband sling of flexible material adjustable in length and formed in a closed loop so as to adapt the head support apparatus to the dimension of the user, said integral headband sling formed from the combination of said one or more straps, sling assembly and headband assembly, whereby said flexible material adjusts the length of the closed loop with respect to the arms and forehead of the user.

15. The head support apparatus of claim 1 wherein said sling assembly further comprising a flap so as to form a pouch, said sling assembly being configured to receive the headband assembly and said one or more straps on an interior formed by the sling assembly, said flap being configured to cover and close the interior so as to wrap said flap in overlapping configuration and be held in proper position.

16. A head support system for allowing a user to rest while sitting in a generally upright position, the system comprising:

(a) a headband assembly configured to be secured to the user's forehead for supporting in a rearward position to restrain the user's head from moving further forward and sideways;

(b) a sling assembly configured to accept the user's arms;

(c) one or more straps configured to connect said headband assembly to said sling assembly and forming a single continuous closed loop;

(d) a headrest assembly comprising a neck pillow configured as a yoke having a rear portion adapted to rest behind a user's neck, and a guide formed as a closed loop through which the one or more straps can freely slide to receive said one or more straps, said neck pillow adapted to receive the neck of the user, said guide located on a rear surface of the neck pillow and adapted to be spaced by the neck pillow away from the back of the neck of the user, whereby the head support system is configured to restrain the user's head from moving forward and sideways by a combined force of the closed loop formed by the headband assembly, the one or more straps, and the sling assembly, by the headband assembly pulling rearward on the user's forehead through the one or more straps and by the user's arm weight in the sling assembly.

17. The head support system of claim 16 further comprising the combination of a blanket having magnetic tabs adapted to secure to magnetic tabs on said sling assembly.

18. The head support system of claim 16 further comprising the combination of a blanket having magnetic tabs adapted to secure to magnetic tabs on said headrest assembly.

* * * * *